United States Patent [19]

Ryan et al.

[11] Patent Number: 4,783,118

[45] Date of Patent: Nov. 8, 1988

[54] MULTI-PURPOSE ARTICLE OF FURNITURE FOR CHILDREN

[76] Inventors: George Ryan; June C. Ryan, both of P.O. Box 260093, Tampa, Fla. 33685

[21] Appl. No.: 17,492

[22] Filed: Feb. 24, 1987

Related U.S. Application Data

[63] Continuation-in-part of Ser. No. 906,369, Sep. 12, 1986, abandoned.

[51] Int. Cl.[4] ..... A47C 13/00

[52] U.S. Cl. ..... 297/3; 297/153; 297/258

[58] Field of Search ..... 297/1, 3, 153, 151, 297/258; 16/30; 5/105; D6/335

[56] References Cited

U.S. PATENT DOCUMENTS

| | | | |
|---|---|---|---|
| D. 144,404 | 4/1946 | Mabry | 297/3 |
| D. 248,516 | 7/1978 | Johansson | D6/335 |
| 1,326,415 | 12/1919 | Negus et al. | 297/1 |
| 2,050,114 | 8/1936 | Moore | 297/153 |
| 2,269,834 | 1/1942 | Wagner | 182/35 |
| 2,675,860 | 4/1954 | Schroeder | 297/151 |
| 3,556,586 | 1/1971 | Beardmore | 297/3 |
| 3,879,083 | 4/1975 | Olsson | 297/1 |
| 4,422,212 | 12/1983 | Sheiman et al. | 16/30 |

FOREIGN PATENT DOCUMENTS

| | | | |
|---|---|---|---|
| 23415 | 1/1949 | Finland | 297/3 |
| 24964 | 11/1951 | Finland | 297/1 |

*Primary Examiner*—James T. McCall

*Attorney, Agent, or Firm*—Charles A. McClure

[57] ABSTRACT

Article of children's furniture useful as a rocker in a first orientation and useful as a high-chair or as a desk when inverted. In both such orientations of the article, a child using it has a seat, a back-rest, a foot-rest, and a ledge conveniently located above and ahead of the seat. In the inverted orientation a tray, readily detachable by an adult but not by a child, is attachable above the ledge as a location for food or for toys or for use as a writing surface. Casters, attachable to the article when in the rocker orientation, facilitate movement of the article when in the inverted position—but not by a child seated therein, who is too short to reach the floor—and double as toys in the rocker orientation. This article of furniture is stable in both its rocking and inverted orientations, and supports a child securely.

9 Claims, 3 Drawing Sheets

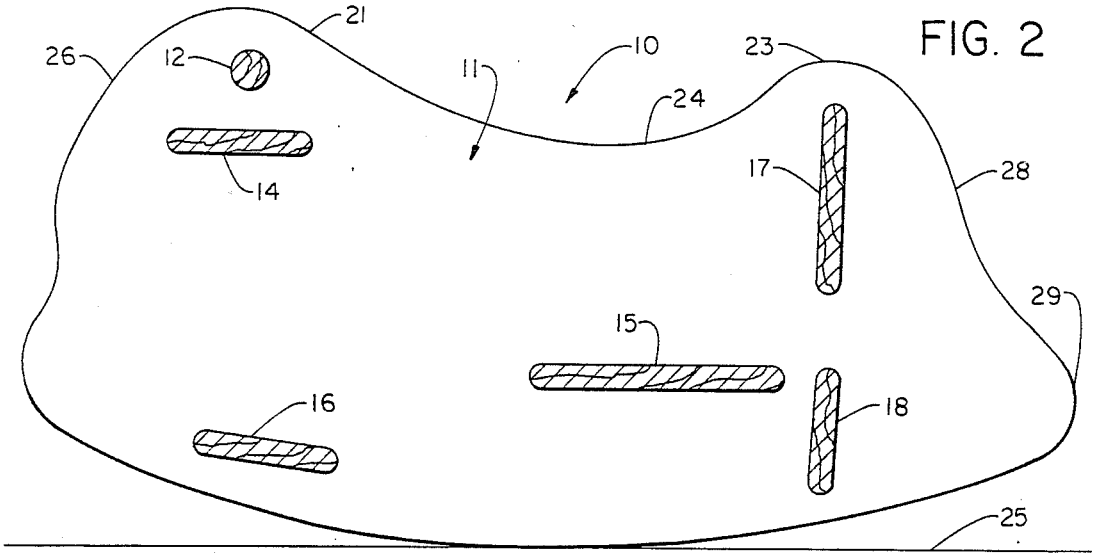
FIG. 2
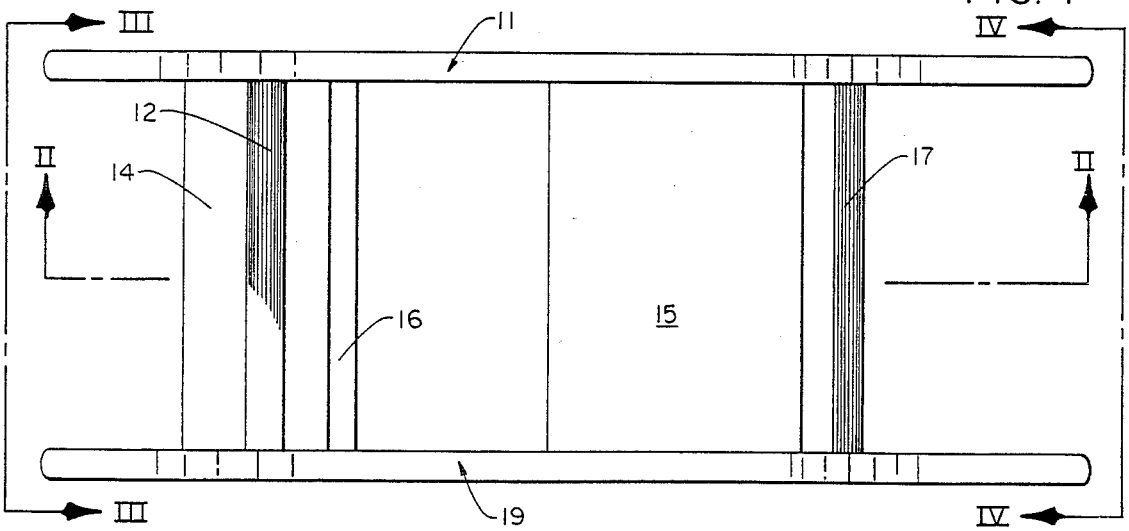
FIG. 1
FIG. 3
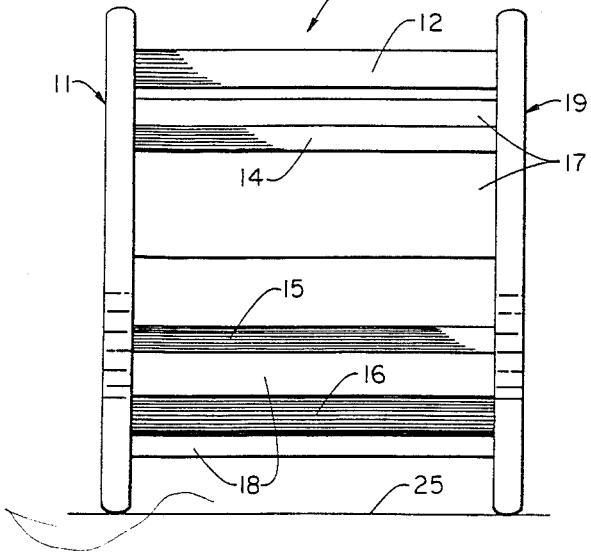
FIG. 4
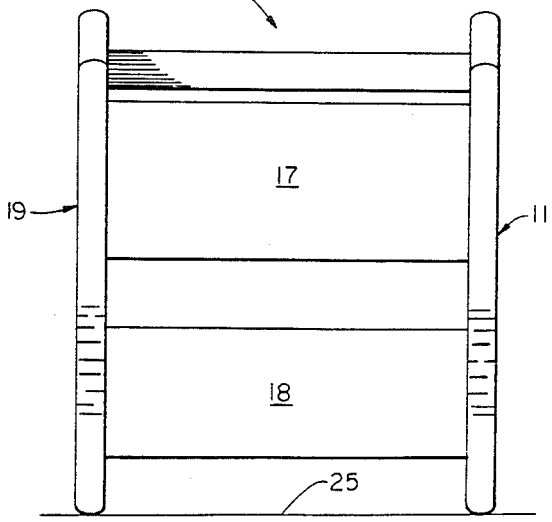

MULTI-PURPOSE ARTICLE OF FURNITURE FOR CHILDREN

BACKGROUND OF THE INVENTION

This is a continuation-in-part of our copending application, Ser. No. 906,369 filed Sept. 12, 1986, now abandoned.

Our invention relates generally to a multi-purpose article of furniture for children, especially such an article useful as a rocker in a first orientation and otherwise useful in a second orientation, being interchangeable from either orientation to the other by inversion, and concerns accessory use therewith.

Many multi-purpose articles of furniture are known, quite a few being intended especially for children. Examples of articles having rocking and fixed chairlike orientations appear in these U.S. Pat. Nos. 1,326,415 to Negus et al.; 2,776,700 to Potter et al.; 3,879,083 to Olsson; and Des. 248,516 to Johansson. Both of the latter also provide more readily movable orientations of such articles, but they comprise the safety and security of the child in their intermediate or high-chair positions.

No known multi-purpose furniture meets the need for a secure place for a child to sit and rock, or to sit in somewhat elevated laterally enclosed position and preferably have at hand items for eating, playing, or writing, while also being readily moved from the outside but not by a child seated therein.

SUMMARY OF THE INVENTION

In general, the various objectives of the present invention are accomplished in a multi-purpose article of furniture useful in a first orientation as a child's rocker and useful in a second orientation as an elevated chair with removable means for a child to eat from, play upon as with toys, or write on as on a slate.

A primary object of the present invention is provision of a multi-purpose article of furniture that a child can sit in and rock or, when the article is inverted, use as a high-chair or as a desk or the like.

Another object of this invention is to provide such article of furniture with a detachable traylike surface for such usage in a preferably stationary location.

A further object of the invention is to provide such article of furniture with detachable casters enabling the article to be moved readily from the outside but not by a child seated therein, and for amusement of the child when the article is in its rocking orientation with casters installed.

Other objects of this invention, together with means and methods for attaining the various objects, will be apparent from the following description and the accompanying drawings of one or more embodiments or variants of the invention, presented here by way of example rather than limitation.

BRIEF DESCRIPTION OF THE DRAWINGS

In those of the following diagrams that are plan views the widthwise dimension is reduced relative to the length and height to conserve space without use of lines to indicate omission, etc. Most corners and protrusions are rounded for enhanced safety of the children who use the items shown.

FIG. 1 is a plan view of an article of furniture according to the present invention in a first or rocker orientation;

FIG. 2 is a side sectional elevation of the same article, taken at II—II in FIG. 1;

FIG. 3 is a front elevation of the article of the preceding views, as indicated at III—III in FIG. 1; and FIG. 4 is a rear elevation of the same article, as taken at IV—IV in FIG. 1.

DETAILED DESCRIPTION

Figure 5:
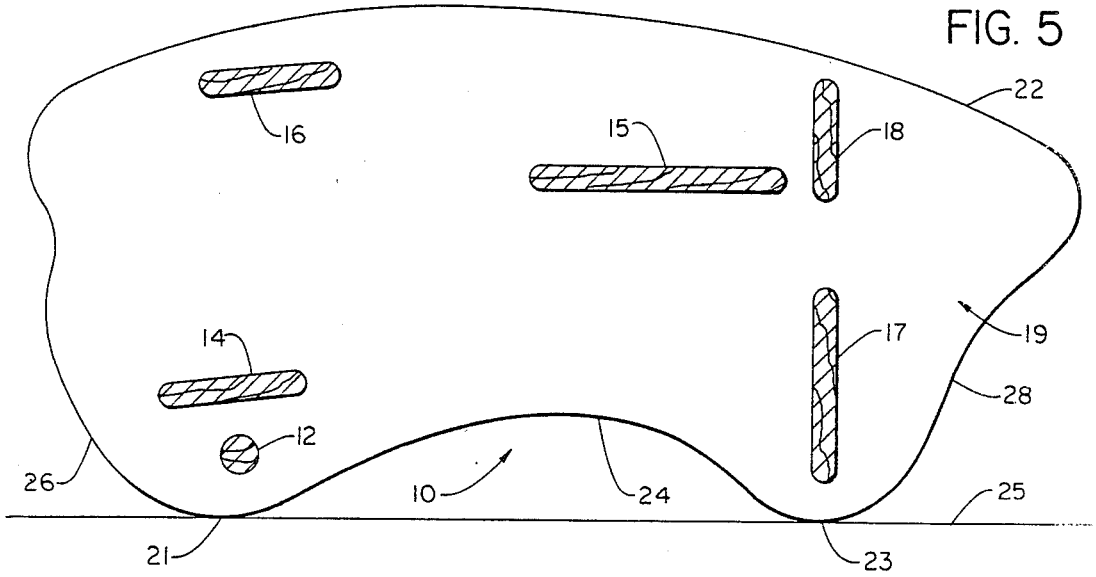
FIG. 5 is a side sectional elevation of the article of the preceding views inverted into a second or non-rocker orientation.

FIG. 1 is a plan (top) view of furniture article 10 of the present invention. This diagram shows sidewall means comprising a pair of parallel upright sidewall panels 11 and 19 at the right side (top of view) and left side (bottom of view), respectively.

Joining the sidewall panels from side to side in FIG. 1 are some transverse members, including cylindrical hand-grip 12, ledge 14 immediately below the hand-grip member, and foot-rest 16 (rear portion only visible) below the ledge member, also seat 15 more centrally located, and back-rest 17 spaced behind the seat (at right side of view).

FIG. 2 is a side sectional elevaton of the same article of furniture, viewed to the right side from a longitudinal bisector, as at II—II in FIG. 1. In addition to showing relative vertical locations of the members shown from above in the preceding view, this shows member 18 (a back-rest in alternative orientation) and the contour or outline of the sidewall panels (only right panel 11 visible). All sectioned members are shaded as being wooden. Longitudinal bottom edge 22 is convex and is resting in FIG. 2 on flat underlying supporting surface 25, showing that this is the rocking orientation of this article of furniture. Top edge 24 is concave, dipping considerably between forward peak 21 and aft peak 23. The top and bottom edges are interconnected by front and rear edges 26 and 28, respectively, with dissimilarly curved outlines. The bottom and rear edges terminate in protruding tail portion 29.

FIGS. 3 and 4 show article of furniture 10 in front and rear elevation, respectively. Hand-grip 12 is visible at the top of each of these views, but most of the members are obscured to some extent by another member, depending upon the view. Thus, viewed from the front, as in FIG. 3, ledge 14 hides part of back-rest 17, and seat 15 and foot-rest 16 hide parts of lower back-rest 18. Likewise, viewed from the front, as in FIG. 4, back-rests 17 and 18 hide all the other members except the hand-grip.

It is apparent from these views of the rocker orientation of the article of furniture of this invention that a child sitting on seat 15, back against back-rest 17, with feet on foot-rest 16, and hands on hand-grip 12, can rock it to and fro by leaning alternately forward and backward in the customary rocking motion. The child is enclosed at the sides by the sidewalls, in front by the hand-grip and nearby ledge, and at the rear by the back-rest. Hence, the child's activity is securely localized even though the rocking may be so vigorous as to move the article gradually along the floor or other underlying supporting surface. At the same time, the child is safe from such hazards as falling or tipping over, or being injured from colliding with an item of furniture or a wall. Moreover, a child is likely to regard such rocking activity as fun, thereby simplifying supervision, as in a roomful of children to be watched. Of course, no child is too likely to want to rock indefinitely, and though sleeping in the rocker can also be expected at times, an alternative orientation of the same article of furniture provides other suitable activities. The second sheet of drawings shows the same article of furniture inverted for such alternative uses.

FIG. 5 is a side sectional elevation of article of furniture 10 inverted into another orientation and otherwise similar to its FIG. 2 showing of rocker configuration. Thus, in FIG. 5 it rests on inverted peaks 21 and 23 of concave edge 24, on underlying flat supporting surface 25. Sidewall 19 in this orientation, now the right sidewall, was the left sidewall in the preceding or rocker orientation, as shown in FIG. 1.

In FIG. 5, the same members are visible as in the similar view (FIG. 2) of the preceding or rocker orientation, but the previous ledge and foot-rest have now interchanged functions so that here ledge 16 is located ahead of and at a higher level than seat 15, whereas foot-rest 14 is ahead of and at a lower level than the seat. Back-rest 18 is now in a position, relative to the seat, to function as such, so back-rest 17 does not perform that function in this new orientation. Seat 15 is intentionally higher than previously, yet the sitting location remains well enclosed laterally by the higher convex edges of the sidewall(s). It is apparent that a child can sit on the seat, with his or her lower back against the back-rest and feet resting on foot-rest 14 to keep from sliding off.

In this non-rocking orientation, the article of furniture of this invention fulfills traditional high-chair functions while avoiding the risks attendant upon the inherent instability and the lack of protective side walls on conventional high chairs.

A child can use ledge 16 to support such items as food, toys, or writing materials, of course. However, according to this invention, a more elegant way of doing so is provided by detachable accessory tray means, shown in subsequent diagrams.

Figure 6:
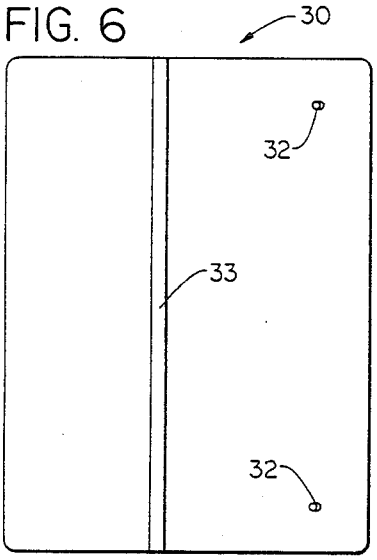
FIG. 6 is a bottom plan view of detachable tray means for the same article of furniture in the latter orientation.

FIG. 6 is a bottom plan view of accessory tray means 30 in rectangular form and with transverse spacer member 33 somewhat closer to the front (at left) than the rear (at right) thereof. It has two pegs 32 extending from locations spaced from the rear edge, and inward somewhat further from the near of its two sides. The pegs are intentionally canted toward the front.

Figure 7:
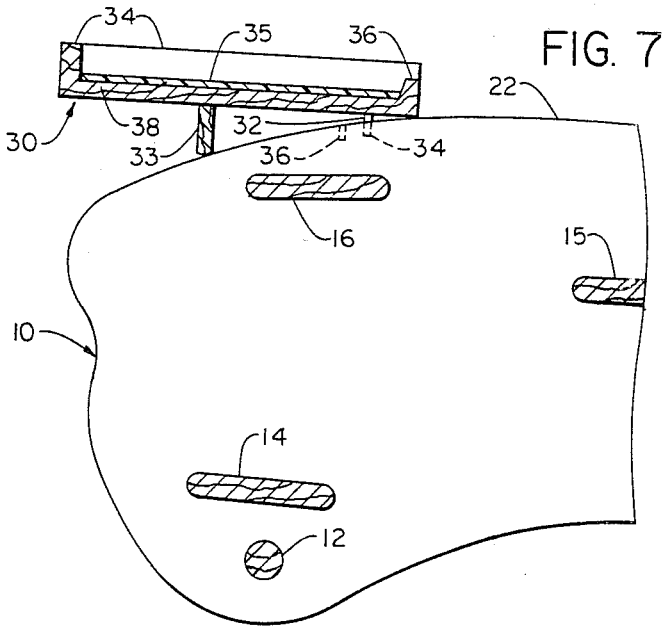
FIG. 7 is a fragmentary side elevation of the same article of furniture, in non-rocking orientation, with the tray means of FIG. 6 attached thereto.

FIG. 7 shows in side sectional elevation the front half of article of furniture 10 in the same orientation as in FIG. 5 but with tray means 30 (also sectioned) attached thereto with pegs 32 (one visible) inserted into a complementary pair of bores 34 in the convex edge of the respective sidewalls (one shown). Second set of bores 36 is also provided (and another set or two may be added) so that the tray location can be adjusted forward or back to suit children of diverse arm lengths or body sizes.

Transverse spacer member 33, resting further forward on the convex surface, holds the tray means sloping upward toward the front to place it at a preferable writing angle. Front and side edges 34 of the tray are higher than somewhat lower rear edge 36. Flat tray surface 35 is bounded by the respective edges and is recessed relative thereto. It preferably is (but need not be) made of dissimilar material, and it is accordingly shaded here as being of plastic composition.

Figure 8:
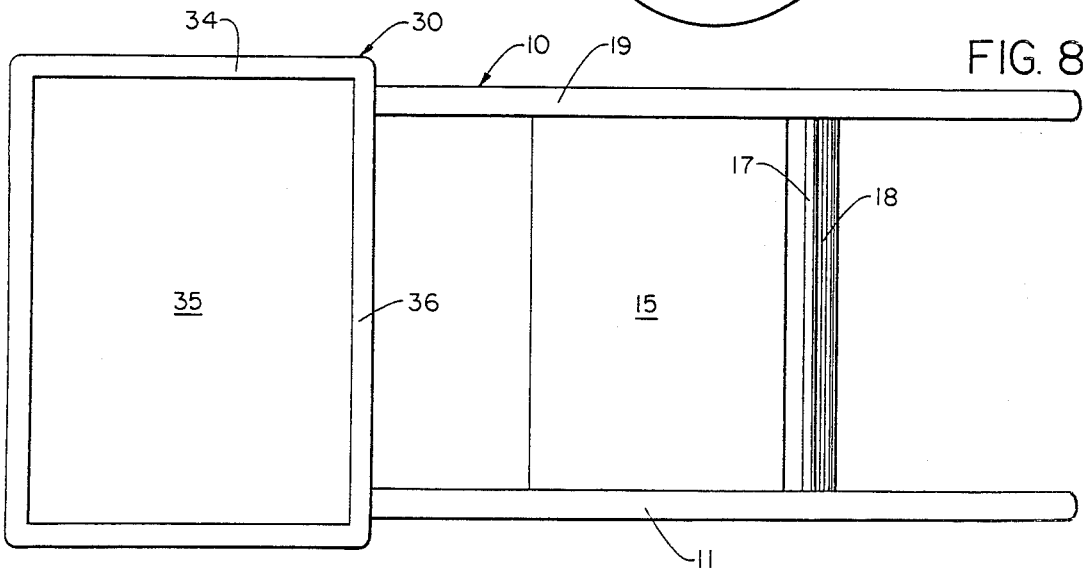
FIG. 8 is a plan view of the same assembly of furniture and tray means as in FIG. 7.

FIG. 8 shows in plan view this article of furniture in desk configuration, with the accessory tray means assembled thereto. The utility of this configuration is readily apparent. A child sitting in the seat has entire tray surface 35 available to write on, to put toys or other objects on, and to eat from. The tray surface can be written directly on with crayons, can have food spilled thereon, or be otherwise dirtied and yet can be cleaned with a dry cloth (for crayon marks) or a damp cloth (for food), with or without the addition of antiseptic, as may be preferred.

The tray of the last several views can be readily detached for separate storage or repair, as and when desired. The canted configuration of the tray-retaining pegs (seen in FIG. 6) resists a child's attempted removal of the tray after assembly of it to article of furniture 10 but yields readily to adult efforts to detach the tray—as by tapping it underneath near the front.

Especially with the tray detached from it, this article of furniture is readily stored, on or (preferably) off the floor, as by being hung by the hand-grip or otherwise from a suitable hook or equivalent support. Such storage is advantageous where space for diverse activities is scarce, and it may enable a child-care facility to accommodate more children than would be permissible with ordinary furniture. Movement of the article to and from the storage location, as well as optional additional use by a child, is facilitated by a modification shown in the next few diagrams.

Figure 9:
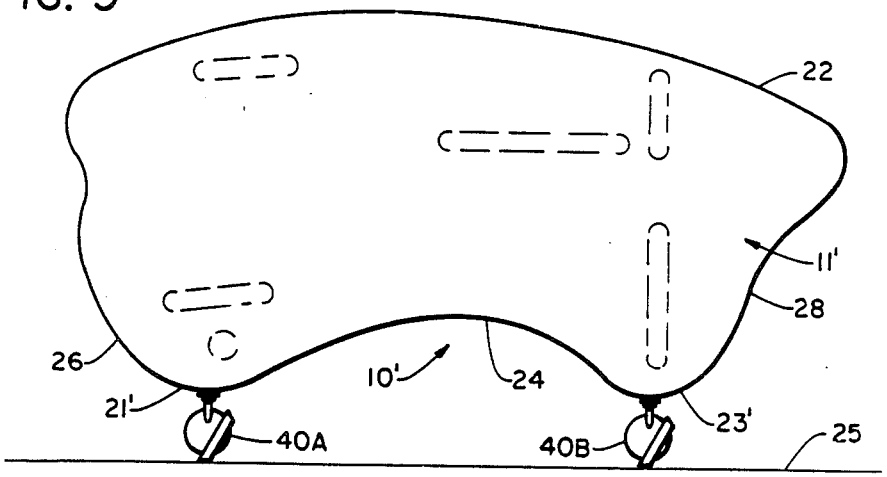
FIG. 9 is a side elevation of a similar article of furniture in non-rocking orientation, differing from the previous article by the addition of casters.

FIG. 9 shows similar article of furniture 10' from the side, in non-rocking orientation, but with casters 40A, 40B installed in (and under) respective front and rear low portions 21' and 23' of side 11' here. Identical casters in the opposite side are not visible in this view. It will be apparent that with such casters installed such article of furniture is readily movable from place to place on the floor or other underlying surface, as by pushing from the outside—not usually by the feet of a child from inside, as a child small enough to be seated in it cannot normally reach the floor.

Figure 10:
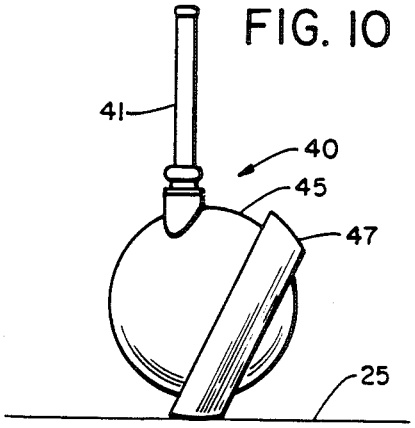
FIG. 10 is a side elevation of such a caster, on an enlarged scale, shown before insertion into or after removal from such an article of furniture.

FIG. 10 shows caster 40 like the casters shown in FIG. 9 but enlarged in scale. Extending up from spherical caster housing 45 is vertical pivot pin 42 offset somewhat from the housing axis and designed to fit into a suitable socket overhead (not shown here). The housing carries canted collar 47 offset at its upper part oppositely to the offset of the pivot pin and intervening at its bottom portion between the housing and underlying surface 25. Such offset construction is conventional and is especially useful in enabling the caster to reorient itself and to roll (only the collar rolls) upon thick carpeting or irregular hard surfaces where smaller center-pin casters frequently fail to operate well.

Figure 11:
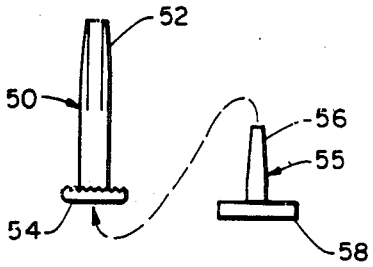
FIG. 11 is a side elevation of a socket for such a caster, and of socket-plugging means useful in the absence thereof.

FIG. 11 shows in side elevation caster pin socket 50, such as is installable in the bore of an article of furniture to hold the pivot pin of a caster securely but removably. Socket 50 has tapered upper end 42 to enter the bore and to hold the pivot pin and has at its lower end enlarged head 44 to abut the under side of the furniture article around the bore, here shown with prongs or teeth to seat in the article if wooden or otherwise receptive. Also shown in side elevation is plug 55 with tapered upper end 56 and head 58 at its lower end. The plug is useful to replace the pivot pin in socket 50 when the caster is not present, with the objectives of keeping the socket clean and preventing children's fingers from possible injury within or because of the socket.

Figure 12:
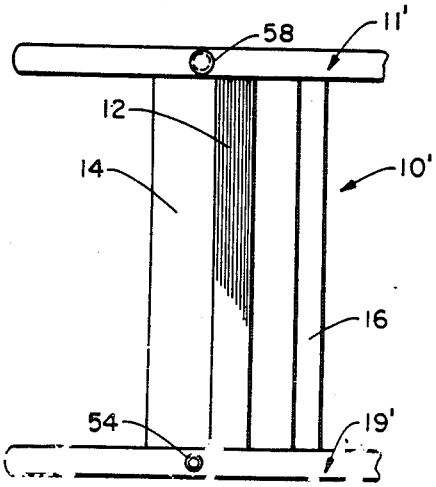
FIG. 12 is a fragmentary bottom plan view of the article of FIG. 9 showing unoccupied sockets for such casters, and the means for plugging them in the absence of the casters.

FIG. 12 shows fragmentarily the under side of article 10' of furniture equipped for casters but without the casters in place. Visible are head 54 of empty caster-receiving socket in side 19' and head 58 of a plug filling a like socket (not visible) in side 11'. Of course, similar plugs could be used to fill bores in such furniture in the absence of any caster-receiving sockets.

Figure 13:
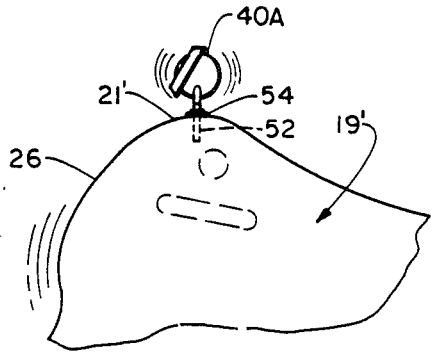
FIG. 13 is a fragmentary side elevation of the same article in rocker orientation with such casters installed.

FIG. 13 shows the upper front corner portion of article 10' in rocker orientation with casters installed. As the child rocks in place, the forward pair (40A shown) will swing around and thus further amuse the child, who may also swing or spin them by hand.

This invention does not require any special materials, tools, or methods of manufacture. Wood is an eminently suitable material, but it may be replaced in whole or part by plastics, such as acrylates, epoxies, nylons, or polyhydrocarbons, which are optionally (and preferably) fiber-reinforced. The surface of the tray is preferably made of hard, readily cleanable material, such as a thermosetting resin (melamine-formaldehyde, phenol-formaldehyde, or urea-formaldehyde). The common kitchen counter version known in the trade as "Formica" is quite suitable for the tray and may be used elsewhere as well. The casters are usually made of metal, but their housings may be (or be coated with) some such plastic, as well.

Conventional fasteners, such as nails or preferably screws (or even dowelling) may be used in assembling the various members to the sidewalls of the exemplified article of furniture or in the tray means. Suitable assembly techniques include cementing, gluing, or similar bonding. Pegging of the tray is preferred to enable its ready removal for use of the article of furniture as a high-chair or for its inversion for use as a rocker, of course, but it may be secured by alternative fastening means if desired.

The convex longitudinal edges are essentially that shape to impart rocker characteristics to the article of furniture, but the concave edges are so shaped to enable a child to get into and out of it, as the seat in that orientation is at a low level to assure stability as the child rocks to and fro. When the article is inverted to the alternative orientation the peaks fore and aft of the concave edges assure stable resting of the article on an underlying supporting surface, whereas the convex edges are high to enclose the child laterally even at such high-chair level. The edges joining the respective longitudinal edges are generally vertical in normal use and preferably are curved or similarly shaped as a precaution so that the article cannot be stood on end by a venturesome child, with potentially hazardous consequences.

It will be apparent that the edge outlines, placement of the transverse members, and dimensioning of the various members can be altered to suit the ages and sizes of the children, or other considerations, such as possible graduated height levels for better visibility in a classroom setting.

Some variants of exemplified embodiments of this invention have been suggested above, and others may come to mind in view of the contents of the drawings and the text of this specification. Other variations may be made, as by adding, combining, deleting, or subdividing parts or steps, while retaining at least some of the advantages and benefits of the invention, which itself is defined in the following claims.

We claim:

1. In a multi-purpose article of furniture for children,
having convex longitudinal edges for supporting it on an underlying surface in rocker orientation, and
having generally concave edges for supporting it on an underlying surface in inverted orientation; and
having in each orientation seat means including a seat member with front and rear edges, and a back-rest member,
the improvement comprising
a pair of back-rest members substantially vertically aligned above and below one another and the rear edge of the seat.

2. Multi-purpose article of furniture according to claim 1, including
detachable tray means
attachable at each side to the convex longitudinal edges,
and resting thereon at its edge nearer to the seat and also at an orienting spacer member between its nearer and farther edges,
usable in such inverted orientation.

3. Multi-purpose article of furniture according to claim 2, so attachable by canted pegs insertable into mating bores in the respective convex longitudinal edges.

4. Multi-purpose article of furniture according to claim 1, including
detachable casters, each having
a non-rotating ball swingable around a vertical axis and
a rotatable collar around such ball and canted relative to such axis,
attachable at the respective peaks of the concave edges to facilitate movement of the article when in such inverted configuration.

5. Multi-purpose article of furniture according to claim 4, wherein the forward pair of casters are within view of a child seated in such article while in the rocking position.

6. Multi-purpose article of furniture according to claim 4, wherein the forward pair of casters are within reach of a child seated in such article while in the rocking position.

7. Multi-purpose article of furniture according to claim 4, wherein the underlying supporting surface is out of reach of a child seated in such article in the rocking orientation.

8. In a child's multi-purpose article of furniture having a pair of sidewall means spaced transversely from each other, each sidewall means having a convex longitudinal edge and a predominantly concave longitudinal edge with end peaks, and each sidewall means having generally vertical end edges interconnecting the ends of its convex and concave edges; and transverse means joining the respective sidewall means and including a seat member and a back-rest member;

being useful as a rocker when in a first orientation resting on the convex edges and alternatively useful as a desk or high-chair when in inverted orientation resting on the concave edges;

the improvement comprising a pair of such back-rest members, substantially vertical, located above and below the rear edge of the seat member, and spaced therefrom at their respective closest approaches thereto;

casters installed in the peaks of the concave longitudinal edges to support such article of furniture movably when resting thereon in the inverted orientation;

wherein the seat member is lower in the rocker orientation and is higher in the desk or high-chair orientation, respectively, such that a child seated therein in the latter orientation is too high to reach the floor with his or her feet and, therefore, can not use the article as a vehicle while so seated therein.

9. Child's multi-purpose article of furniture, useful as a rocker in a first orientation and as a high-chair in an inverted orientation when supported on an underlying surface, comprising laterally spaced sidewalls having convex longitudinal edges so supporting such article in a first or rocker orientation, and concave longitudinal edges so supporting such article in a second or high-chair orientation;

transverse means joining the respective sidewalls and including seat means having a member closer to the convex edges than to the concave edges useful as a seat in either such orientation, back-rest means extending substantially vertically above and below a transverse rear edge of the seat member and including a pair of spaced members useful respectively as a back rest in the respective orientations, and means including a pair of members longitudinally offset above and below the seat member and useful interchangeably as a ledge and a foot-rest member in the respective orientations; and detachable casters, each having a non-rotating ball swingable around a vertical axis and a rotatable collar around such ball and canted relative to such axis, so attached at the respective peaks of the concave edges to facilitate movement of the article when in high-chair configuration.

* * * * *